US008931467B2

(12) United States Patent
Lee

(10) Patent No.: US 8,931,467 B2
(45) Date of Patent: Jan. 13, 2015

(54) MAGAZINE RIFLE

(75) Inventor: Si Young Lee, Seoul (KR)

(73) Assignee: Si Young Lee, Seoul (KR)

( * ) Notice: Subject to any disclaimer, the term of this patent is extended or adjusted under 35 U.S.C. 154(b) by 585 days.

(21) Appl. No.: 13/243,559

(22) Filed: Sep. 23, 2011

(65) Prior Publication Data

US 2013/0008421 A1 Jan. 10, 2013

(30) Foreign Application Priority Data

Jul. 5, 2011 (KR) ..... 10-2011-0066561
Jul. 11, 2011 (KR) ..... 10-2011-0068305

(51) Int. Cl.

| | |
|---|---|
| ***F41B 11/00*** | (2013.01) |
| ***F41A 9/73*** | (2006.01) |
| ***F41A 9/23*** | (2006.01) |
| ***F41A 9/26*** | (2006.01) |

(52) U.S. Cl.

CPC ... *F41A 9/73* (2013.01); *F41A 9/23* (2013.01); *F41A 9/26* (2013.01)

USPC ..... 124/56; 124/45; 89/33.1

(58) Field of Classification Search

CPC ..... F41B 11/52; F41B 11/62; F41B 11/00; F41B 11/57; F41B 11/54; F41B 11/50; F41A 9/73; F41A 9/74

USPC ..... 124/56, 60, 70, 71, 72, 73, 75, 76, 77, 124/45; 89/33.1

See application file for complete search history.

(56) References Cited

U.S. PATENT DOCUMENTS

| | | | | | |
|---|---|---|---|---|---|
| 4,899,717 | A * | 2/1990 | Rutten et al. | ..... | 124/67 |
| 4,986,251 | A * | 1/1991 | Lilley | ..... | 124/67 |
| 4,993,400 | A * | 2/1991 | Fitzwater | ..... | 124/48 |
| 5,150,701 | A * | 9/1992 | Wackrow et al. | ..... | 124/67 |
| 5,709,199 | A * | 1/1998 | Johnson et al. | ..... | 124/69 |
| 5,878,734 | A * | 3/1999 | Johnson et al. | ..... | 124/59 |
| 6,152,125 | A * | 11/2000 | Piper | ..... | 124/59 |
| 6,279,562 | B1 * | 8/2001 | Clayton | ..... | 124/59 |
| 6,364,162 | B1 * | 4/2002 | Johnson et al. | ..... | 222/61 |
| 6,439,216 | B1 * | 8/2002 | Johnson et al. | ..... | 124/70 |
| 6,752,137 | B2 * | 6/2004 | Brunette et al. | ..... | 124/74 |
| 7,458,371 | B2 * | 12/2008 | Ong et al. | ..... | 124/65 |
| 7,712,462 | B2 * | 5/2010 | Pedicini et al. | ..... | 124/65 |
| 7,730,881 | B1 * | 6/2010 | Pedicini et al. | ..... | 124/65 |
| 7,975,682 | B2 * | 7/2011 | Yang | ..... | 124/67 |

(Continued)

FOREIGN PATENT DOCUMENTS

| | | | | |
|---|---|---|---|---|
| EP | 341090 A2 * | 11/1989 | ..... | F41B 11/02 |
| FR | 2631557 A3 * | 11/1989 | ..... | A63H 5/04 |

(Continued)

*Primary Examiner* — Benjamin P Lee

(74) *Attorney, Agent, or Firm* — McDermott Will & Emery LLP

(57) ABSTRACT

Disclosed herein is a magazine rifle which includes a bullet loading mechanism and a firing mechanism interlinked to operate together by a single motor, thereby enabling single bullet firing, semi-automatic firing, and fully automatic firing. The magazine rifle includes a rotatable magazine, a bullet loading mechanism which loads a bullet received in the rotatable magazine into a cartridge chamber, and a firing mechanism which discharges compressed air from a compressed air cylinder according to manipulation of a trigger to allow the bullet loaded in the cartridge chamber to be fired through a barrel. The bullet loading mechanism and the firing mechanism are driven by a drive unit automatically driven by a single motor and a gear connected to the motor.

18 Claims, 9 Drawing Sheets

(56) References Cited

U.S. PATENT DOCUMENTS

| | | | | |
|---|---|---|---|---|
| 8,100,120 | B2 * | 1/2012 | Maeda | 124/77 |
| 8,136,515 | B2 * | 3/2012 | Galinson | 124/59 |
| 8,146,577 | B2 * | 4/2012 | Hu | 124/32 |
| 8,297,269 | B2 * | 10/2012 | Hu | 124/67 |
| 8,402,958 | B2 * | 3/2013 | Victor et al. | 124/45 |
| 8,430,085 | B2 * | 4/2013 | Tippmann et al. | 124/73 |
| 8,449,346 | B2 * | 5/2013 | Lee | 446/405 |
| 8,567,380 | B2 * | 10/2013 | Nugent | 124/65 |
| 2002/0185050 | A1 * | 12/2002 | Hilleman | 114/337 |
| 2005/0183709 | A1 * | 8/2005 | Marsac | 124/63 |
| 2005/0235975 | A1 * | 10/2005 | Pedicini et al. | 124/67 |
| 2006/0231083 | A1 * | 10/2006 | Tsurumoto | 124/66 |
| 2006/0243263 | A1 * | 11/2006 | Tsurumoto | 124/66 |
| 2007/0000483 | A1 * | 1/2007 | Tsurumoto | 124/73 |
| 2007/0101982 | A1 * | 5/2007 | Ong et al. | 124/65 |
| 2007/0261689 | A1 * | 11/2007 | Tai et al. | 124/67 |
| 2009/0056692 | A1 * | 3/2009 | Maeda | 124/63 |
| 2010/0319668 | A1 * | 12/2010 | Maeda | 124/73 |
| 2010/0326414 | A1 * | 12/2010 | Maeda | 124/74 |
| 2011/0083654 | A1 * | 4/2011 | Galinson | 124/59 |
| 2012/0192847 | A1 * | 8/2012 | Hague et al. | 124/77 |

FOREIGN PATENT DOCUMENTS

| | | | | |
|---|---|---|---|---|
| FR | 2837565 | A1 * | 9/2003 | F41B 11/00 |
| JP | 03221793 | A * | 9/1991 | F41B 11/28 |

* cited by examiner

MAGAZINE RIFLE

BACKGROUND

1. Field of the Invention

Embodiments of the invention relate to magazine rifles and, more particularly, to a magazine rifle which includes a bullet loading mechanism and a firing mechanism interlinked to operate together by a single motor, thereby enabling single bullet firing, semi-automatic firing, and fully automatic firing.

2. Description of the Related Art

Generally, rifles are configured to store compressed air in a compression tank, to move and load a single bullet from a magazine into a cartridge chamber through manipulation of a bullet loading mechanism, and to allow the bullet loaded in the cartridge chamber to be fired by the compressed air stored in the compression tank when a trigger is pulled.

Some rifles are provided with a rotatable magazine which loads bullets into a cartridge chamber while rotating on the rifle. However, a conventional rifle generally requires a user to directly manipulate a bullet loading lever by hand in order to load a bullet into the cartridge chamber. Therefore, the conventional rifle cannot perform repeated firing.

To solve such a problem, semi-automatic type rifles designed to reuse compressed air used for firing a bullet have been developed. However, since such a semi-automatic type rifle also requires a user to directly manipulate a bullet loading lever when loading a bullet, this rifle is necessarily provided with a bullet loading lever. Further, since previously used compressed air is used in this type rifle, it is difficult to control pressure of the compressed air and it is very difficult to manufacture such rifle.

BRIEF SUMMARY

The present invention is conceived to solve the problems as described above, and an aspect of the present invention is to provide a magazine rifle which includes a bullet loading mechanism and a firing mechanism interlinked to operate together by a single motor, thereby enabling single bullet firing, semi-automatic firing, and fully automatic firing.

According to an aspect of the present invention, a magazine rifle includes: a rotatable magazine; a bullet loading mechanism which loads a bullet received in the rotatable magazine into a cartridge chamber; and a firing mechanism which discharges compressed air from a compressed air cylinder according to manipulation of a trigger to allow the bullet loaded in the cartridge chamber to be fired through a barrel, wherein the bullet loading mechanism and the firing mechanism are driven by a drive unit automatically driven by a single motor and a gear connected to the motor.

The drive unit may include a motor driven by manipulation of the trigger; a worm gear coupled to a rotary shaft of the motor to be rotated thereby; and a disk-shaped main worm gear plate having first teeth formed on an outer periphery thereof to engage with the worm gear to rotate therewith.

The bullet loading mechanism may include a bullet recoil stick which pushes the bullet loaded in the rotatable magazine to the cartridge chamber; a recoil stick housing into which a rear end of the bullet recoil stick is inserted, with an elastic member interposed between the rear end of the bullet recoil stick and the recoil stick housing; a recoil stick housing gear linearly formed on an outer surface of the recoil stick housing; and a circular recoil stick gear coupled to one side of the main worm gear plate and engaging with the recoil stick housing gear to advance the recoil stick housing gear.

The bullet loading mechanism may include a recoil stick locker catching a rear end of the recoil stick housing to prevent the recoil stick housing from moving backwards, with the recoil stick housing gear advanced to a point where the bullet is pushed into the cartridge chamber by the recoil stick; and a recoil stick unlocker coupled to the other side of the recoil stick gear to rotate together with the recoil stick gear and having a releasing jaw protruding from one side thereof to change a position of the recoil stick locker by pushing a releasing section of the recoil stick locker such that the recoil stick housing is moved backwards.

Each of the recoil stick housing gear and the recoil stick gear may be formed to have a constant pitch between adjacent gear teeth thereof.

The firing mechanism includes a hammer unit rotated by elasticity of an elastic member and striking a valve in the compressed air cylinder to supply compressed air into the cartridge chamber; a hammer gear formed in a sector shape on an upper surface of the hammer unit; and a hammer moving gear coupled to the other side of the main worm gear plate to rotate together and rotatably engaging with the hammer gear to move the hammer gear to a side opposite the valve.

The hammer unit may include a hinge portion rotatably coupled to a hinge, the elastic member provided to the hinge portion and imparting elasticity to the hammer unit, and a hammer coupled to the hinge portion and striking the valve.

Each of the hammer gear and the hammer moving gear may be formed to have a constant pitch between adjacent gear teeth thereof.

The hammer moving gear may include a first semi-circular section having three gear teeth formed thereon and a second semi-circular section having no gear teeth thereon.

The releasing jaw may be disposed at a place to release the recoil stick locker such that the recoil stick is moved backwards after the hammer unit strikes the valve with the second semi-circular section of the hammer moving gear.

The magazine rifle may further include a magnet provided to one side of the main worm gear plate; and a magnetic sensor detecting the number of revolutions and a rotated position of the main worm gear plate by sensing the magnet.

The rotatable magazine may include: a bullet insertion wheel having a rotation hole formed at a center thereof and a plurality of bullet insertion chambers circumferentially formed around the rotation hole; a rear cover surrounding a rear side of the bullet insertion wheel, and including a rotary shaft penetrating the rotation hole and a first bullet penetrating hole at a portion of the rear cover below the rotary shaft; a front cover fastened to the rear cover and rotatably surrounding a front side of the bullet insertion wheel, the front cover including a second bullet penetrating hole corresponding to the first bullet penetrating hole; a wheel rotator rotating the bullet insertion wheel in a first rotational direction when there is no external force applied to the bullet insertion wheel; and a wheel rotation controller allowing sequential rotation of the bullet insertion wheel by a distance corresponding to a pitch between the bullet insertion chambers in association with movement of the bullet loading mechanism, which loads bullets received in the bullet insertion chambers into the cartridge chamber while passing through the bullet insertion chambers.

The rear cover may be provided at a lower side thereof with a wheel spacing member protruding towards the front cover to provide a space into which the bullet insertion wheel is inserted so as to rotate therein.

The wheel rotator may include a rotation guide groove formed on an inner surface of the rear cover; a guide jaw protruding from a rear side of the bullet rotating wheel towards the rear cover and guiding a rotational direction of the bullet rotating wheel along the rotation guide groove; and a first elastic member disposed between the rear cover and the bullet rotating wheel to provide force for rotating the bullet rotating wheel in the first rotational direction by accumulating elasticity upon rotation of the bullet rotating wheel in a second rotational direction.

The rotation guide groove may have a broken O shape.

The wheel rotation controller may include a wheel rotation control groove formed on the front side of the bullet rotating wheel inside the bullet insertion chambers; an elevation member provided to the front cover to slide in a vertical direction, the elevation member being lifted upon forward movement of the bullet loading mechanism into the front cover and being lowered upon backward movement of the bullet loading mechanism from the front cover; an eccentric descent mechanism compressing one side of an upper surface of the elevation member to force the elevation member to be eccentrically descended; and a rotation restricting jaw protruding from a rear side of the elevation member to restrict a rotating distance of the bullet rotating wheel so as to be equal to the pitch between the bullet insertion chambers while moving over the wheel rotation control grooves.

The wheel rotation control groove may include a plurality of chamber catching grooves corresponding to the plurality of bullet insertion chambers, respectively. Each of the chamber catching grooves may have an inclined surface along which the rotation restricting jaw can be easily moved to an adjacent subsequent chamber catching groove upon rotation of the bullet rotating wheel in a second rotational direction.

The elevation member may include a body having a flat upper surface and a circular lower surface; a movement guide hole formed through a center of the body to allow a movement guide protrusion formed on the front cover to pass therethrough; and a projection jaw protruding downwards from a lower side of the body and having a lower end descending into the second bullet penetrating hole upon downward movement of the elevation member such that the lower end of the projection jaw is moved up or down according to forward or backward movement of the bullet loading mechanism.

The eccentric lowering mechanism may include an eccentric compression member provided to the front cover to slide in a vertical direction and to rotate thereon and eccentrically compressing one side of an upper surface of the elevation member; and a second elastic member disposed between an upper portion of the eccentric compression member and the front cover to push the elevation member to a lower side of the eccentric compression member using elasticity.

The rotatable magazine may further include a surface cover coupled to a front side of the front cover and covering the wheel rotation controller.

BRIEF DESCRIPTION OF THE DRAWINGS

The above and other aspects, features and advantages of the invention will become apparent from the following description of exemplary embodiments given in conjunction with the accompanying drawings, in which.

DETAILED DESCRIPTION OF THE EMBODIMENTS

Exemplary embodiments of the present invention will now be described in detail with reference to the accompanying drawings.

Figure 1:
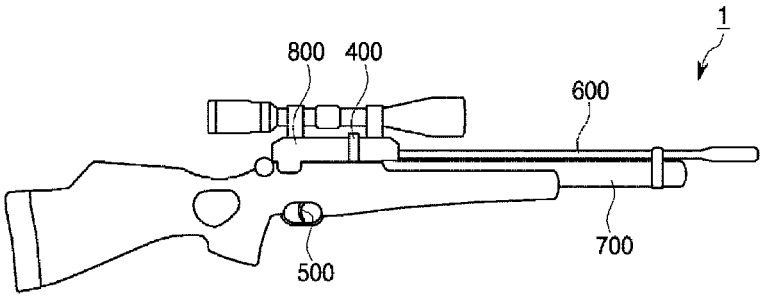
FIG. 1 is a side view of a magazine rifle according to one exemplary embodiment of the present invention.

Referring to FIG. 1, a magazine rifle 1 according to one exemplary embodiment of the invention includes a rotatable magazine 400, a bullet loading mechanism 100, a firing mechanism 200, a drive unit 300, a trigger 500, a barrel 600, and a compressed air cylinder.

Other components of the rifle according to this embodiment except for the bullet loading mechanism 100, the firing mechanism 200 and the drive unit 300 are substantially the same as those of a general rifle, and detailed descriptions thereof will thus be omitted herein. Herein, the bullet loading mechanism 100, the firing mechanism 200 and the drive unit 300 of the magazine rifle according to this embodiment will be described in detail.

First, the drive unit 300 automatically drives the bullet loading mechanism 100 and the firing mechanism 200 using a single motor for providing drive power. In this embodiment, the drive unit 300 includes a motor 310, a worm gear 320 and a main worm gear plate 330, as shown in FIG. 2.

The motor 310 may be a DC motor, which is driven by a DC power source, and may be driven to provide power for all components of the magazine rifle 1 by manipulation of the trigger 500. In other words, when a user pulls trigger 500 and applies force thereto, electric power is applied to the motor 310 by the force applied to the trigger 500, so that the motor 310 is rotated. Here, a rotating duration of the motor 310 increases in proportion to a pulling duration of the trigger 500.

Figure 2:
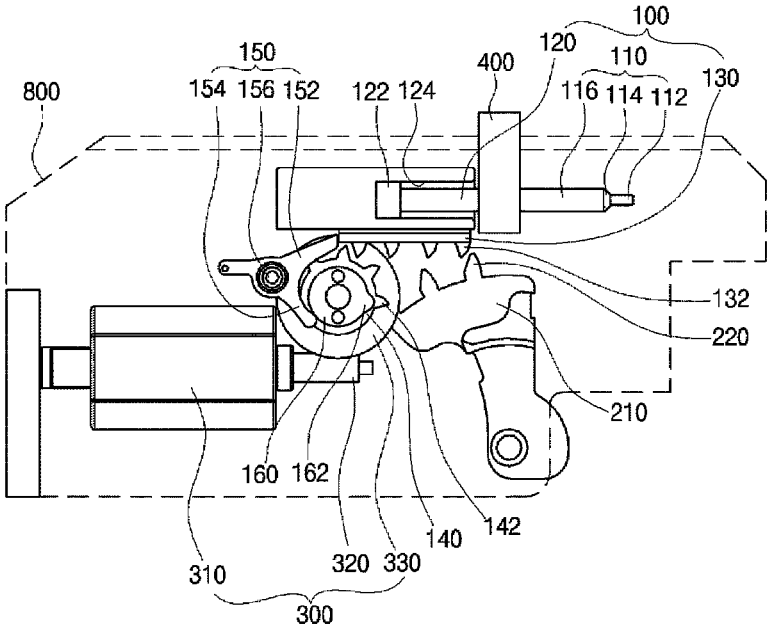
FIG. 2 is a side view of a bullet loading mechanism, a firing mechanism and a drive unit of the magazine rifle according to the exemplary embodiment of the present invention.

Referring to FIG. 2, the worm gear 320 is connected to a rotary shaft of the motor 310. Since the worm gear 320 is connected to the rotary shaft of the motor 310, the worm gear 320 is rotated at the same speed as that of the motor 310. The worm gear 320 has gear teeth formed on an outer periphery thereof. Further, the main worm gear plate 330 has a disk shape with first gear teeth formed on an outer periphery thereof such that the first gear teeth engage with the worm gear 320 to rotate therewith. Thus, the main worm gear plate 330 is finally rotated by the worm gear 320, which is rotated by the motor 310 at the same speed as that of the motor 310. The main worm gear plate 330 is connected at both sides thereof to various gear plates for driving the bullet loading mechanism 100 and the firing mechanism 200 described below.

Figure 3:
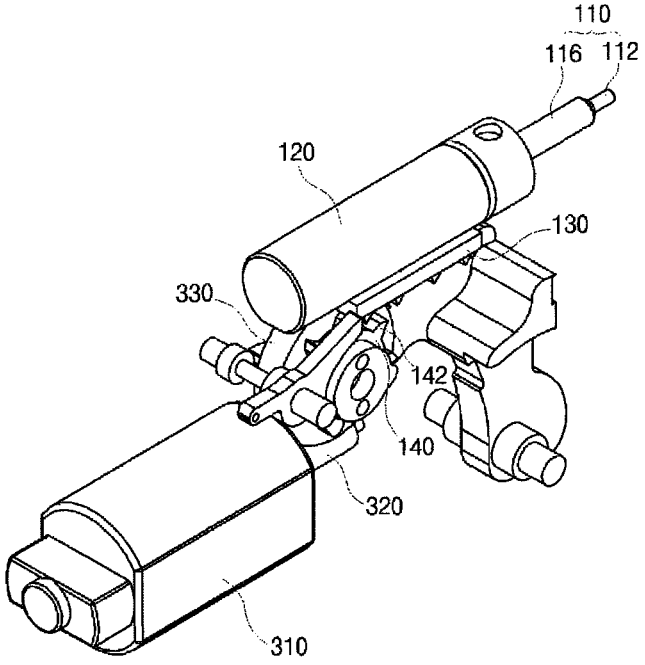
FIG. 3 is a perspective view of the bullet loading mechanism, firing mechanism and drive unit of the magazine rifle according to the exemplary embodiment of the present invention.

The bullet loading mechanism 100 serves to load a bullet, which is received in the rotatable magazine 400, into a cartridge chamber. In this embodiment, the bullet loading mechanism 100 is operated in association with the firing mechanism by the drive unit 300 to allow bullets to be automatically loaded one by one into the cartridge chamber. The bullet loading mechanism 100 include a bullet recoil stick 110, a recoil stick housing 120, a recoil stick housing gear 130, and a recoil stick gear 140, as shown in FIGS. 2 and 3.

First, the bullet recoil stick 110 serves to push a bullet received in the rotatable magazine 400 into the cartridge chamber. Thus, the bullet recoil stick 110 has an elongated bar shape and a diameter suited to pass through a hole of the rotatable magazine 400. Furthermore, as shown in FIGS. 2 and 3, the bullet recoil stick 110 includes a leading end 112 having a small diameter, a tapered middle section 114 having a gradually increasing diameter, and a rear end 116 having a constant diameter, thereby providing a two-stepped structure. The bullet recoil stick 110 having such a two-stepped structure is used for additional operation of a specific component of the rotatable magazine 400 using advancing motion of the bullet recoil stick.

The recoil stick housing 120 is configured to receive the rear end of the bullet recoil stick 110 with an elastic member 122 interposed therebetween. Thus, as shown in FIG. 2, the recoil stick housing 120 is formed with a groove 124, which is sized to allow the rear end of the bullet recoil stick 110 to be inserted into the recoil stick housing 120 therethrough, and the groove 124 is provided with the elastic member 122, for example, a spring, which compresses the bullet recoil stick 110 by elasticity. The elastic member 122 accumulates elasticity through contraction during forward movement of the recoil stick housing 120 and the bullet recoil stick 110, and forces the recoil stick housing 120 and the bullet recoil stick 110 to retreat due to the accumulated elasticity when external force applied to the recoil stick housing gear 130 described below is removed Further, the recoil stick housing 120 is disposed to freely move forwards or backwards along a path in the case 800. Namely, the recoil stick housing 120 is inserted into the path to accurately move forwards or backwards along the path, which is formed to allow the recoil stick housing 120 to move towards or out of the cartridge chamber.

The recoil stick housing gear 130 has a rack gear shape and is provided to an outer surface of the recoil stick housing 120, for example, to a lower surface of the recoil stick housing 120. More specifically, the recoil stick housing gear 130 may have a plurality of rack gear teeth formed at a lower side thereof, and may be integrally formed with the recoil stick housing 120 or may be separately formed therefrom to be coupled thereto, as shown in FIG. 2. Thus, the recoil stick housing gear 130 is moved together with the recoil stick housing 120 and engages with the recoil stick gear 140 described hereinafter.

Further, as shown in FIGS. 2 and 3, the recoil stick gear 140 is disposed to engage with one side of the main worm gear plate 330 to move together therewith. As described above, the recoil stick gear 140 engages with the recoil stick housing gear 130 to move the recoil stick housing gear 130 in a forward direction.

Accordingly, the recoil stick gear 140 has a substantially disk shape and is formed on the outer periphery thereof with gear teeth, which engage with the recoil stick housing gear 30. Preferably, as shown in FIG. 2, the recoil stick gear 140 has two half-circle sections on the outer periphery thereof. One of the half-circle sections is formed with four gear teeth 142 and the other half-circle section is formed with no gear teeth. In a rotation range of the half-circle section having the gear teeth 142, the recoil stick housing gear 130 is pushed and moved forwards by the recoil stick gear 140, and in a rotation range of the other half-circle section, the recoil stick housing gear 130 is not pushed and remains freely. Thus, the recoil stick housing gear 130 may be stopped or retreated by operation of a recoil stick locker 150 and a recoil stick unlocker 160 described below.

Further, according to this embodiment, the gear teeth 132, 142 formed on each of the recoil stick housing gear 130 and the recoil stick gear 140 may be disposed to have a constant pitch therebetween. Namely, as shown in FIG. 2, the constant pitch between adjacent gear teeth may fundamentally prevent a possibility of malfunction which can occur upon engagement of the respective gear teeth.

The bullet loading mechanism 100 is further provided with the recoil stick locker 150 and the recoil stick unlocker 160, as described above. First, the recoil stick locker 150 prevents backward movement of the recoil stick housing 120 by locking the rear end of the recoil stick housing gear 130 when the recoil stick housing gear 130 is moved forwards to push a bullet into the cartridge chamber. Referring to FIG. 2, the recoil stick locker 150 may include a latch jaw 152, an unlocking portion 154, and a rotational center 156. The latch jaw 152 engages with the rear side of the recoil stick housing gear 130 and is coupled to the rotational center 156.

The unlocking portion 154 is bifurcated from the latch jaw 152 and is coupled to the rotational center 156 to contact an outer periphery of the recoil stick unlocker 160. The rotational center 156 serves as a central axis for rotation of the latch jaw 152 and the unlocking portion 154, and is provided with an elastic member (not shown) which continues to push the latch jaw 152 towards the recoil stick housing 120. The elastic member forces the latch jaw 152 to continuously move towards the recoil stick housing 120 unless external force is applied to the latch jaw 152.

Referring to FIGS. 2 and 3, the recoil stick unlocker 160 is coupled to the other side of the recoil stick gear 140 to rotate together with the recoil stick gear 140. The recoil stick unlocker 160 pushes the unlocking portion 154 of the recoil stick locker 150 using an unlocking jaw 162 which protrudes from the recoil stick unlocker 160 to one side to move the recoil stick housing 120 backwards by changing the position of the latch jaw 152. Namely, one side of the recoil stick gear 140 is closely coupled to one side of the main worm gear plate 330, and the other side of the recoil stick gear 140 is coupled to the recoil stick unlocker 160. Thus, the main worm gear plate 330, the recoil stick gear 140 and the recoil stick unlocker 160 are rotated together.

Specifically, the recoil stick unlocker 160 has a disk shape, and the unlocking jaw 162 protrudes from an outer surface thereof. When the unlocking jaw 162 encounters the unlocking portion 154 during rotation, the unlocking jaw 162 pushes the unlocking portion 154, so that the latch jaw 152 is moved downwards in association with movement of the unlocking portion 145, allowing the recoil stick housing 120 and the recoil stick housing gear 130 to move backwards.

Then, when the recoil stick housing gear 130 is moved forwards again for a subsequent firing process, the latch jaw 152 tends to move upwards and is caught by the rear end of the recoil stick housing gear 130, thereby preventing backward movement of the recoil stick housing 120.

In the rifle 1 according to this embodiment, a point where the unlocking jaw 162 pushes the unlocking portion 154 to retreat the recoil stick housing 120 and the bullet recoil stick 110 is a very important feature. In other words, in the magazine rifle 1 according to this embodiment, the bullet recoil stick 110 serves not only to allow a bullet received in the rotatable magazine 400 to be loaded into the cartridge chamber by pushing the bullet, but also to close the cartridge chamber until compressed air is supplied by the firing mechanism 200 to fire the bullet, such that pressure of the compressed air is effectively used to fire the bullet. In other words, the bullet recoil stick 110 completely closes a rear opening of the cartridge chamber, thereby preventing the compressed air from leaking in other directions instead of in a direction of the bullet.

Consequently, since the bullet recoil stick 110 must remain in the cartridge chamber, instead of moving out of the cartridge chamber, until the bullet is fired by the firing mechanism 200, it is important for the unlocking jaw 162 to realize accurate control of retreat timing of the bullet recoil stick 110 in association with the firing mechanism 200. Specifically, the unlocking jaw 162 may be disposed at a place to release the recoil stick locker 150 such that the bullet recoil stick 110 moves forwards, immediately after a hammer unit 212 strikes the valve to allow the bullet to be fired by placement of a second semi-circular section 234 of a hammer moving gear 230 described above.

According to this embodiment, the rifle may omit the recoil stick locker and the recoil stick unlocker. In this case, the last gear tooth among the gear teeth of the recoil stick gear may be circumferentially elongated to retard backward movement of the recoil stick housing 120 and the recoil stick housing gear 130.

Figure 4:
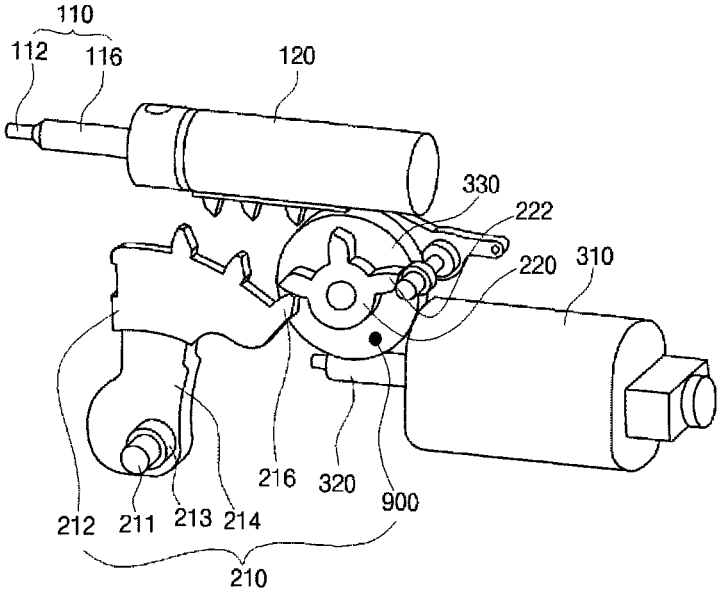
FIG. 4 is a perspective view of the bullet loading mechanism, firing mechanism and drive unit of the magazine rifle according to the exemplary embodiment of the present invention, which are viewed from a different angle.

The firing mechanism 200 discharges compressed air from the compressed air cylinder 700 according to manipulation of the trigger 500 to allow a bullet loaded in the cartridge chamber to be fired through a barrel. Referring to FIGS. 2 and 4, the firing mechanism 200 includes a hammer unit 210, a hammer gear 220 and the hammer moving gear 230.

First, the hammer unit 210 is rotated by elasticity of an elastic member 213 in one direction, i.e. towards the valve of the compressed air cylinder, and strikes the valve of the compressed air cylinder 700 to supply compressed air into the cartridge chamber. The hammer unit 210 may include a hinge portion 214, an elastic member 216, and a hammer unit 212, as shown in FIG. 4.

The hinge portion 214 is coupled to a rotary shaft 211 via a hinge to permit rotation of other components. The hinge portion 214 is provided with the elastic member 213 which applies elasticity to force the hammer unit 212 to always rotate in one direction, that is, towards the valve when external force is not applied thereto. The elastic member 213 may be a spring and may be wound around the rotary shaft 211 of the hinge portion 214.

The hammer unit 212 is coupled to the hinge portion 214 and directly strikes the valve. This hammer unit 212 may be integrally formed with the hinge portion 214 or separately formed to be coupled to the hinge portion 214.

Referring to FIG. 4, the hammer gear 216 is formed in a sector shape on an upper surface of the hinge portion 214. The hammer gear 216 engages with the hammer moving gear 220 described below to force the hammer unit 212 to move opposite the valve.

Referring again to FIG. 4, the hammer moving gear 220 is joined to the other side of the main worm gear plate 330 to rotate together therewith, and engages with the hammer gear 216 to force the hammer gear 216 to move opposite the valve. Specifically, the hammer moving gear 220 has a disk shape and is coupled to the other side of the main worm gear plate 330, that is, a side opposite the side of the main worm gear plate 330 to which the recoil stick gear 140 is coupled, to rotate together with the main worm gear plate 330. The hammer moving gear 220 is formed on an outer periphery thereof with gear teeth 222, as shown in FIG. 4.

Here, the hammer moving gear 220 includes a first half-circle section having three gear teeth 222 disposed in a sector arrangement and a second half-circle section which has no gear teeth, as shown in FIG. 4. Thus, the hammer moving gear 220 rotates together with the main worm gear plate 330 to force the hammer unit 210 to move opposite the valve while the gear teeth of the first half-circle section engage with the hammer gear 216. Then, when the second half-circle section of the hammer moving gear 220 reaches the hammer unit 210, the hammer moving gear 220 cannot hold the hammer unit 210 since the second half-circle section does not have gear teeth engaging with the hammer gear 216. Accordingly, since the hammer unit 210 is not subjected to external force, the hammer unit 212 is rotated by elasticity of the elastic member 213 to strike the valve.

Further, according to this embodiment, in the firing mechanism 200, each of the hammer gear 216 and the hammer moving gear 220 may be formed to have a constant pitch between adjacent gear teeth 216 or 222 formed thereon. The constant pitch between the adjacent gear teeth 216 or 222 provides a space for accurate engagement between the hammer gear 216 and the hammer moving gear 220 for a subsequent firing process even when the hammer unit 212 is slightly pushed backwards due to repulsion after striking the valve.

The main worm gear plate 330 may be provided at one side thereof with a magnet 900, as shown in FIG. 4. The magnet 900 is detected by a magnetic sensor (not shown) separately provided to the magazine rifle 1, such that the magnetic sensor provides information for accurate firing timing and firing position control through detection of the number of revolutions and an accurate rotated position of the main worm gear plate 330. Accordingly, the magazine rifle 1 according to this embodiment is capable of realizing a single shot firing mode, a semi-automatic firing mode, a burst mode, and a fully automatic successive firing mode through accurate detection and control not only of the number of revolutions of the main worm gear plate 330 but also of the rotated position thereof.

Referring again to FIG. 1, the rotatable magazine 400 according to this embodiment may be detachably attached to an upper side of the rifle 1, specifically, to a magazine insertion groove formed on the case 800 of the rifle 1. In particular, the rotatable magazine 400 is received in the magazine insertion groove so as to accurately engage with the bullet loading mechanism received in the case 800 to associate with each other, such that a plurality of bullets can be automatically loaded one by one from the rotatable magazine 400 into the cartridge chamber in association with operation of the bullet loading mechanism.

Figure 5:
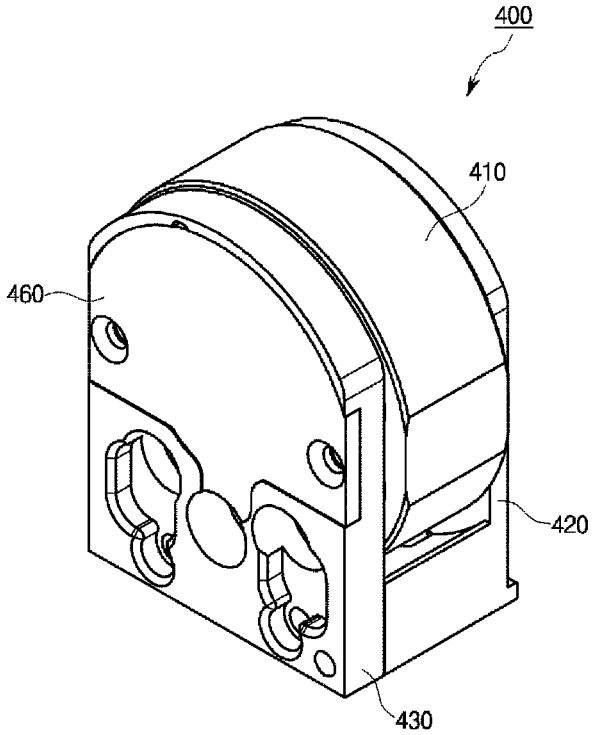
FIG. 5 is a perspective view of an automatic rotation magazine according to one exemplary embodiment of the present invention.

Referring to FIG. 5, the automatic rotation magazine 400 according to this embodiment includes a bullet insertion wheel 410, a rear cover 420, a front cover 430, a wheel rotator 440, a wheel rotation controller 450, and a surface cover 460.

Figure 8:
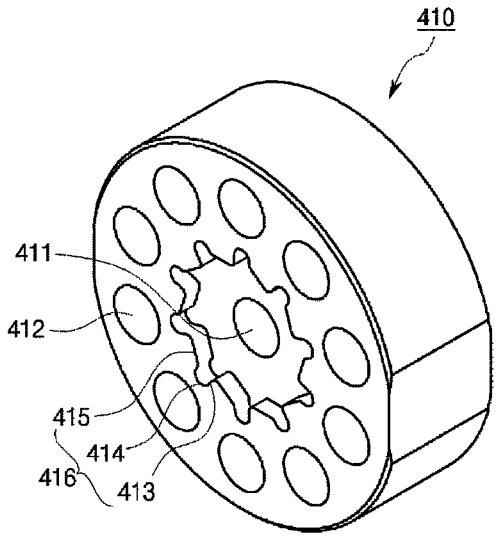
FIG. 8 is a front view of a bullet insertion wheel of the magazine according to the exemplary embodiment of the present invention.

First, referring to FIG. 8, the bullet insertion wheel 410 includes a rotation hole 411 formed at a center thereof and a plurality of bullet insertion chambers 412 circumferentially arranged around the rotation hole 411. When assembled, the bullet insertion wheel 410 is rotatably mounted in a space created between the rear cover 420 and the front cover 430 coupled to each other, as shown in FIG. 5.

In the bullet insertion wheel 410, the number of bullet insertion chambers 412 may be variously set, and the size of the bullet insertion chamber 412 may be determined to be slightly greater than a diameter of a bullet so as to allow the bullet to be easily inserted into and exit from the bullet insertion chamber 412. If the bullet insertion chambers 412 have an excessively large size, there can be a problem in that the bullets are likely to be separated from the bullet insertion chambers 412 or to move therein.

On the other hand, the rotation hole 411 is formed through the center of the bullet insertion wheel 410 such that a rotary shaft 422 described below penetrates the rotation hole 411 to allow the bullet insertion wheel 410 to rotate at an accurate location.

Figure 6:
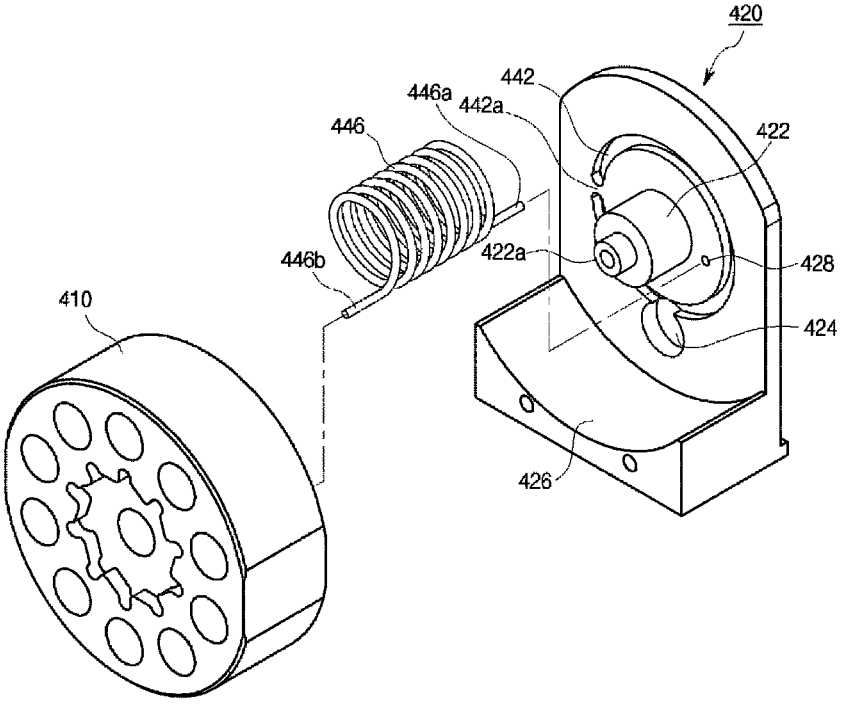
FIG. 6 is a perspective view of a rear cover of the magazine according to the exemplary embodiment of the present invention.

When assembled, the rear cover 420 is configured to surround a rear side of the bullet insertion wheel 410, as shown in FIG. 5. The rear cover 420 is provided with the rotary shaft 422 penetrating the rotation hole 411, and formed with a first bullet penetrating hole 424 through a portion of the rear cover 420 below the rotary shaft 422, as shown in FIG. 6. Namely, when assembled, the rear cover 420 surrounds the rear side of the bullet insertion wheel 410 and the rotary shaft 422 is inserted into the rotation hole 411 to allow rotation of the bullet insertion wheel 410 thereon.

Therefore, the rotary shaft 422 may have a smaller diameter than the rotation hole 411 such that the rotary shaft 422 is inserted into the rotation hole 411 and can be easily rotated therein. Particularly, a leading end 422*a* of the rotary shaft 422 may have a two-stepped structure to be coupled to the front cover 430 described below, as shown in FIG. 7.

Figure 7:
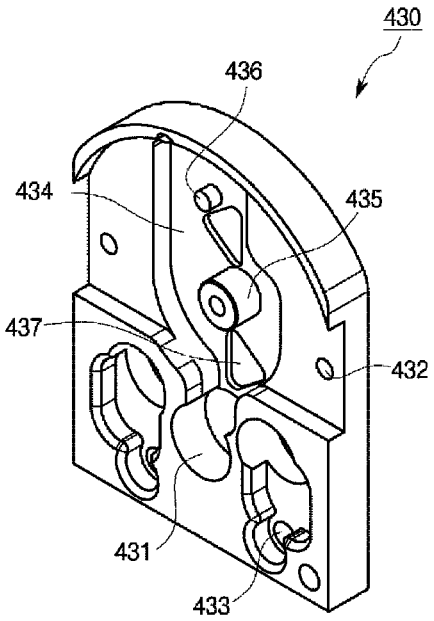
FIG. 7 is a front view of a front cover of the magazine according to the exemplary embodiment of the present invention.

Further, as shown in FIG. 7, the first bullet penetrating hole 424 is formed through a portion of the rear cover 420 below the rotary shaft 422. The first bullet penetrating hole 424 is formed to coincide with each of the bullet insertion chambers 412 when each of the bullet insertion chambers is rotated to face the first bullet penetrating hole 424, with the bullet insertion wheel 410 assembled to the rear cover 420. Accordingly, while the bullet loading mechanism pushes a bullet received in the bullet insertion chambers 412 towards the cartridge chamber, the bullet and part of the bullet loading mechanism pass through the first bullet penetrating hole 412.

As a result, when the automatic rotation magazine 400 is mounted on the rifle 1, the first bullet penetrating hole 412 is accurately positioned corresponding to the cartridge chamber.

Further, as shown in FIG. 7, the rear cover 420 is provided with a wheel spacing member 426 which protrudes from a lower side of the rear cover 420 towards the front cover 430. The wheel spacing member 426 separates the front cover 430 and the rear cover 420 from each other so as to prevent the bullet insertion wheel 410 from contacting and interfering with the front cover 430 or rear cover 420, with the rear cover 420 assembled to the front cover 430. Therefore, preferably, the wheel spacing member 426 is slightly thicker than the bullet insertion wheel 410.

Further, a rotation guide groove 428 described below is formed around the rotary shaft 422 of the rear cover 420 and has a broken O-shape, as shown in FIG. 6.

Referring to FIG. 5, the front cover 430 is fastened to the rear cover 420 and surrounds a front side of the bullet insertion wheel 410 so as to allow rotation thereof. Thus, the bullet insertion wheel 410 may be stably rotated in a space between the front cover 430 and the rear cover 420 without being separated therefrom.

Further, as shown in FIG. 7, the front cover 430 is formed with a second bullet penetrating hole 431 at a portion thereof coinciding with the first bullet penetrating hole 424. The second bullet penetrating hole 431 has the same size as that of the first bullet penetrating hole 422 and is formed to accurately coincide with the first bullet penetrating hole 422 when the automatic rotation magazine 400 is assembled to the rifle.

The second bullet penetrating hole 431 constitutes a passage through which a bullet passes in a process of supplying the bullet into the automatic rotation magazine 400, and through which a portion of the bullet loading mechanism passes in a process of loading a bullet into the cartridge chamber.

On the other hand, the front cover 430 is formed with fastening orifices 432 near the middle of right and left sides thereof such that fastening members are coupled to the fastening holes 432 when the front cover 430 is fastened to the surface cover 460 described below. Further, the front cover 430 is formed at lower right and left sides thereof with fastening holes 433 through which fastening members pass to fasten the front cover 430 to the rear cover 420.

The wheel rotator 440 rotates the bullet insertion wheel 410 in a first rotational direction when no external force is applied to the bullet insertion wheel 410. Herein, the term "first rotational direction" refers to a clockwise or counterclockwise direction, in which the bullet insertion wheel 410 tends to rotate by accumulated elasticity upon loading of a bullet.

According to this embodiment, the wheel rotator 440 includes a rotation guide groove 442, a guide jaw, and a first elastic member 446. First, referring to FIG. 6, the rotation guide groove 442 is formed on the rear cover 420 to surround the rotary shaft.

Here, the rotation guide groove 442 has a 'broken O-shape', which means that a circle is partially cut to form an open circle instead of a complete circle. In this embodiment, a left part 442 of the rotation guide groove 422 is cut to form an open circle, as shown in FIG. 6.

The guide jaw (not shown) protrudes from a rear side of the bullet rotating wheel 410 towards the rear cover 420 to guide rotation of the bullet rotating wheel 410 along the rotation guide groove 442.

The guide jaw allows the bullet rotating wheel 410 to remain partially inserted into the rotation guide groove 442 when the bullet rotating wheel 410 is assembled to the automatic rotation magazine 400. In this state, as the bullet rotating wheel 410 is rotated, the guide jaw moves along the rotation guide wheel 442 until it reaches the open portion 442*a* of the rotation guide wheel 442 and stops rotation of the bullet rotating wheel 410.

Accordingly, in a process of supplying a plurality of bullets into the automatic rotation magazine 400 such that the bullets are sequentially inserted into the bullet insertion chambers 412, bullet insertion is performed while the plurality of bullet insertion chambers is rotated in a direction opposite the first rotational direction, until all of the bullets are completely inserted into the bullet insertion chambers 412 and the guide jaw and the rotation guide groove 442 stop further rotation of the bullet rotating wheel 410.

Referring to FIG. 6, the first elastic member 446 is disposed between the rear cover 420 and the bullet rotating wheel 410, and forces the bullet rotating wheel 410 to be rotated in the first rotational direction by elasticity accumulated during rotation of the bullet rotating wheel 410 in a second rotational direction, that is, in a direction opposite the first rotational direction.

As shown in FIG. 6, the first elastic member 446 is, for example, a coil spring, and is bent at both ends thereof 446*a*, 446*b* to be perpendicular to a coil spring moving direction. One end 446*a* of the first elastic member 446 is inserted into a first coil insertion groove 428 which is formed on an inner surface of the rear cover 410, and the other end 446*b* is inserted into a second coil insertion groove (not shown) which is formed on the rear side of the bullet rotating wheel 410.

As a result, the first elastic member 446 is secured in a compressed state between the rear cover 420 and the bullet rotating wheel 410 with the bullet rotating wheel 410 coupled to the rear cover 420, accumulates elasticity during rotation of the bullet rotating wheel 410 in the second direction, and rotates the bullet rotating wheel 410 using the accumulated elasticity during rotation of the bullet rotating wheel 410 in the first direction.

The wheel rotation controller 450 allows sequential rotation of the bullet insertion wheel 410 to be performed by a distance corresponding to a pitch between the bullet insertion chambers 412 in association with movement of the bullet loading mechanism which loads bullets from the bullet insertion chambers 412 to the cartridge chamber while sequentially penetrating the bullet insertion chambers 412.

Figure 10:
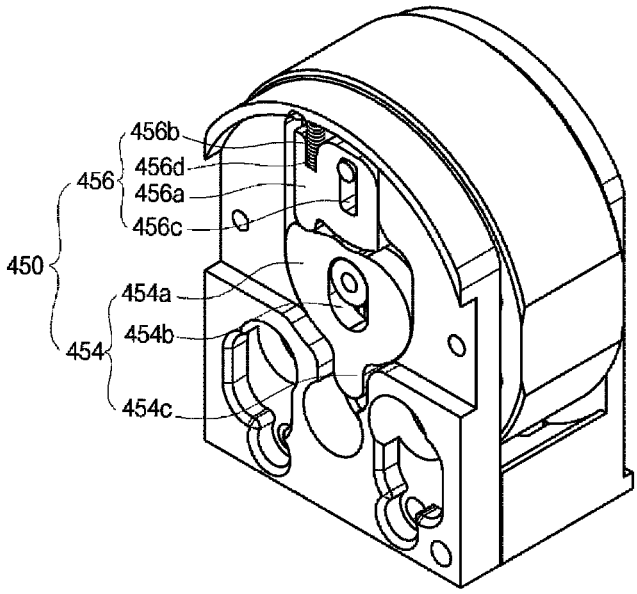
FIG. 10 is a perspective view of a wheel rotation controller of the magazine according to the exemplary embodiment of the present invention.

Referring to FIG. 10, according to this embodiment, the wheel rotation controller 450 is disposed on a mounting recess 434 of the front cover 430. The bullet loading mechanism sequentially passes through the second bullet penetrating hole 431, the bullet insertion chamber 412 and the first bullet penetrating hole 422 when loading a bullet, and moves backwards after the bullet is fired. At this time, the bullet loading mechanism sequentially escapes from the first bullet penetrating hole 422 and the bullet insertion chambers 412, thereby allowing the bullet rotating wheel 410 to rotate. Here, since the wheel rotation controller 450 is mounted on the front cover 430, the wheel rotation controller 450 is lowered to restrict a rotating distance of the bullet rotating wheel 410 after the bullet loading mechanism escapes from the second bullet penetrating hole 431. Accordingly, the bullet rotating wheel 410 is sequentially rotated a distance corresponding to the pitch between adjacent bullet insertion chambers through operation of the wheel rotation controller 450 and the bullet loading mechanism, thereby enabling automatic loading of bullets into the cartridge chamber.

Specifically, according to this embodiment, the wheel rotation controller 450 includes the mounting recess 434, wheel rotation control grooves 416, an elevation member 454, an eccentric descent mechanism 456, and a rotation restricting jaw 458. First, referring to FIG. 7, the mounting recess 434 is formed at a central region on a front side of the front cover 430 to provide spaces for mounting the elevation member 454, the eccentric descent mechanism 456 and the rotation restricting jaw 458.

In particular, the mounting recess 434 is formed with a first movement guide protrusion 435 and a second movement guide protrusion 436 above the first movement guide protrusion 435. The first movement guide protrusion 435 guides elevation of the elevation member 454 and the second movement guide protrusion 436 guides movement of the eccentric descent mechanism 456.

The mounting recess 434 is formed at a lower portion thereof with a triangular rotation restricting jaw penetrating hole 437 through which the rotation restricting jaw 458 described below penetrates. Through the restricting jaw penetrating hole 437, the rotation restricting jaw 458 restricts a rotating angle of the bullet rotating wheel 410 while climbing over the wheel rotation control grooves 416 described below.

Referring to FIGS. 6 and 8, the wheel rotation control grooves 416 are formed on regions of the front side of the bullet rotating wheel 410 corresponding to the bullet insertion chambers 412. In this embodiment, the wheel rotation control grooves 416 include a plurality of chamber latch grooves 414, which are connected to each other and correspond to the respective bullet insertion chambers 412. Here, a left side of each of the chamber latch grooves 414 has a gently inclined surface 415 to facilitate movement of the rotation restricting jaw 458 from one chamber latch groove 414 to the next chamber latch groove 414 during rotation of the bullet rotating wheel 410 in the second direction, and a right side of each of the chamber latch grooves 414 has a steeply inclined surface 413 to prevent the rotation restricting jaw 458 from climbing over the chamber latch groove 414 without position shifting.

Referring to FIG. 10, the elevation member 454 is disposed on the front cover 430 to slide up or down and to rotate thereon. The elevation member 454 is pushed upwards when the bullet loading mechanism enters the front cover, and is lowered when the bullet loading mechanism is moved out of the front cover. Specifically, a lower end of the elevation member 454 partially protrudes towards the second bullet penetrating hole 431 when assembled to the front cover. Then, when the bullet loading mechanism pushes the lower end of the elevation member 454 upwards while passing through the second bullet penetrating hole 431, the entirety of the elevation member 454 is moved upwards together with the rotation restricting jaw 458 formed on the elevation member 454 and moves over the chamber latch groove 414.

Figure 9:
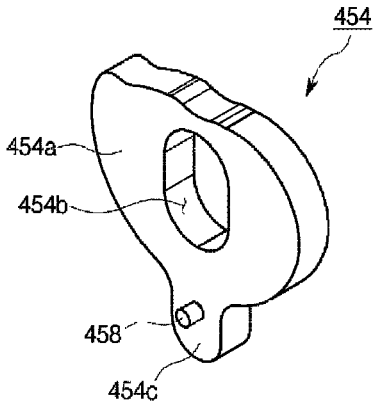
FIG. 9 is a perspective view of an elevation member of the magazine according to the exemplary embodiment of the present invention.

Specifically, referring to FIG. 9, the elevation member 454 includes a body 454*a*, a movement guide hole 454*b*, and a projection jaw 454*c*. First, the body 454*a* generally has a planar shape with a flat upper surface and a rounded lower surface. The movement guide hole 454*b* is formed through the center of the body 454*a* such that the movement guide protrusion 435 of the front cover 430 passes therethrough, when the elevation member 454 is assembled to the first cover, as shown in FIG. 10. In this embodiment, the movement guide hole 454*b* has an elongated circular shape to allow vertical sliding and rotation of the elevation member 454 therein.

Referring to FIG. 9, the projection jaw 454*c* protrudes from a lower side of the body 454*a* and is lowered into the second bullet penetrating hole 431 upon downward movement of the elevation member 454 to be moved up or down by forward or rearward movement of the bullet loading mechanism.

The eccentric descent mechanism 456 elastically compresses one side of the upper surface of the elevation member 454 to eccentrically descend the elevation member 454. Referring to FIG. 10, the eccentric descent mechanism 456 includes an eccentric compression member 456*a* and a second elastic member 456*b*. First, the eccentric compression member 456*a* is received in the mounting recess 434 of the front cover 430 to slide up or down and to rotate therein, and eccentrically compresses one side of the upper surface of the elevation member 454.

Accordingly, the eccentric compression member 456*a* generally has a planar shape and is formed at the center thereof with an elongated circular through-hole 456*c*, as shown in FIG. 10. The elongated circular shape of the through-hole 456*c* enables vertical sliding and rotation of the eccentric compression member 456*a*.

Referring to FIG. 10, the second elastic member 456*b* is disposed between an upper side of the eccentric compression member 456*a* and the front cover 430 and pushes the eccentric compression member 456*a* in a downward direction using elasticity. As shown in FIG. 10, for stable assembly of the second elastic member 456*b*, the eccentric compression member 456*a* is preferably formed at an upper portion thereof with an elastic member insertion groove 456*d*. Particularly, the elastic member insertion groove 456*d* is formed near one side of the eccentric compression member 456*a* instead of at the center thereof, and the second elastic member 456*b* is configured to eccentrically compress the eccentric compression member 456*a* towards one side.

Accordingly, the eccentric compression member 456*a* continues to compress the elevation member 454 such that the elevation member 454 is forced to rotate from the left to the right in the figure. As a result of such eccentric compression of the elevation member 454, the rotation restricting jaw 458 is compressed towards the steeply inclined surface 413 at the right side of the chamber latch grooves 414 so as to prevent the rotation restricting jaw 458 from climbing over the steeply inclined surface 413 when the rotation restricting jaw 458 described below tend to climb over the chamber latch grooves 414, and the rotation restricting jaw 458 is compressed to rapidly move to an adjacent chamber latch groove when the rotation restricting jaw 458 escapes from one chamber latch groove 414.

The rotation restricting jaw 458 protrudes from the rear side of the body 454*a* in a thickness direction and engages with the chamber latch groove 414 through the restricting jaw penetration hole 437. Further, vertical movement of the projection jaw 454*c* and eccentric operation of the first elastic member allow the rotation restricting jaw 458 to restrict the rotating angle of the bullet rotating wheel 410 to the pitch of a single bullet insertion chamber 412 and to climb over the plurality of chamber latch grooves 414.

Figure 11:
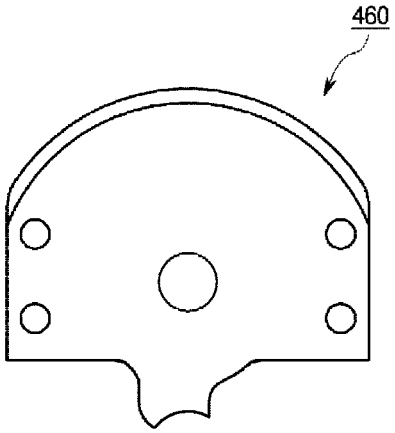
FIG. 11 is a front view of a surface cover of the magazine according to the exemplary embodiment of the present invention.

Finally, as shown in FIG. 5, the surface cover 460 is coupled to the front cover 430 and covers the wheel rotation controller 450. Referring to FIG. 11, the surface cover 460 is fastened to the front cover 430 by fastening members such as screws.

In the magazine rifle according to the embodiments, a bullet loading mechanism and a firing mechanism are interlinked to each other to operate together by a single motor driven by manipulation of a trigger and a gear connected to the motor, thereby providing a single shot firing mode, a semi-automatic firing mode, a burst mode, and a fully automatic successive firing mode.

In particular, the magazine rifle according to the embodiments may completely prevent the bullet loading mechanism and the firing mechanism from malfunctioning in the successive firing mode, and may facilitate conversion between the single shot firing mode, burst mode and the successive firing mode according to a period of time and the number of times a trigger is pulled.

In addition, according to the embodiments, since the magazine rifle employs only a single motor and gears connected thereto, the rifle has a simplified overall structure, permits easy fabrication, and has a low possibility of malfunction. Further, advantageously, the rifle does not need a separate power source for the bullet loading mechanism and the firing mechanism.

The rotatable magazine according to the embodiments may be easily inserted into a rifle and permits bullets to be automatically loaded one by one in association with operation of the bullet loading mechanism of the rifle having a simple mechanical structure without a separate controller, so that the magazine is suitable for successive firing.

Although some embodiments have been described herein, it will be apparent to those skilled in the art that the embodiments are given by way of illustration and that various modifications, additions, changes and variations can be made without departing from the spirit and scope of the invention. Accordingly, the scope of the invention should be limited only by the accompanying claims.

What is claimed is:

1. A magazine rifle comprising:

a rotatable magazine;

a bullet loading mechanism which loads a bullet received in the rotatable magazine into a cartridge chamber; and a firing mechanism which discharges compressed air from a compressed air cylinder according to manipulation of a trigger to allow the bullet loaded in the cartridge chamber to be fired through a barrel, wherein the bullet loading mechanism and the firing mechanism are driven by a drive unit automatically driven by a single motor and a gear connected to the motor;

wherein the drive unit comprises:

a motor driven by manipulation of the trigger;

a worm gear coupled to a rotary shaft of the motor to be rotated thereby; and a disk-shaped main worm gear plate having first teeth formed on an outer periphery thereof to engage with the worm gear to rotate therewith; and further wherein the bullet loading mechanism comprises:

a bullet recoil stick which pushes the bullet loaded in the rotatable magazine to the cartridge chamber;

a recoil stick housing into which a rear end of the bullet recoil stick is inserted, with an elastic member interposed between the rear end of the bullet recoil stick and the recoil stick housing;

a recoil stick housing gear linearly formed on an outer surface of the recoil stick housing; and a circular recoil stick gear coupled to one side of the main worm gear plate and engaging with the recoil stick housing gear to advance the recoil stick housing gear.

2. The magazine rifle of claim 1, wherein the bullet loading mechanism comprises:

a recoil stick locker catching a rear end of the recoil stick housing to prevent the recoil stick housing from moving backwards, with the recoil stick housing gear advanced to a point where the bullet is pushed into the cartridge chamber by the recoil stick; and a recoil stick unlocker coupled to one side of the recoil stick gear to rotate together with the recoil stick gear and having a releasing jaw protruding from one side thereof to change a position of the recoil stick locker by pushing a releasing section of the recoil stick locker such that the recoil stick housing is moved backwards.

3. The magazine rifle of claim 1, wherein each of the recoil stick housing gear and the recoil stick gear is formed to have a constant pitch between adjacent gear teeth thereof.

4. The magazine rifle of claim 1, wherein the firing mechanism comprises:

a hammer unit rotated by elasticity of an elastic member and striking a valve in the compressed air cylinder to supply compressed air into the cartridge chamber;

a hammer gear formed in a sector shape on an upper surface of the hammer unit and having a sector shape; and a hammer moving gear coupled to the other side of the main worm gear plate to rotate together and rotatably engaging with the hammer gear to move the hammer gear to a side opposite the valve.

5. The magazine rifle of claim 4, wherein the hammer unit comprises a hinge portion rotatably coupled to a hinge, the elastic member provided to the hinge portion and imparting elasticity to the hammer unit, and a hammer coupled to the hinge portion and striking the valve.

6. The magazine rifle of claim 4, wherein each of the hammer gear and the hammer moving gear is formed to have a constant pitch between adjacent gear teeth thereof.

7. The magazine rifle of claim 4, wherein the hammer moving gear comprises a first semi-circular section having three gear teeth formed thereon and a second semi-circular section having no gear teeth thereon.

8. The magazine rifle of claim 4, wherein the releasing jaw is disposed at a place to release the recoil stick locker such that the recoil stick is moved backwards after the hammer unit strikes the valve with the second semi-circular section of the hammer moving gear.

9. The magazine rifle of claim 8, further comprising:

a magnet provided to one side of the main worm gear plate; and a magnetic sensor detecting the number of revolutions and a rotated position of the main worm gear plate by sensing the magnet.

10. A magazine rifle comprising:

a rotatable magazine;

a bullet loading mechanism which loads a bullet received in the rotatable magazine into a cartridge chamber; and a firing mechanism which discharges compressed air from a compressed air cylinder according to manipulation of a trigger to allow the bullet loaded in the cartridge chamber to be fired through a barrel, wherein the bullet loading mechanism and the firing mechanism are driven by a drive unit automatically driven by a single motor and a gear connected to the motor;

wherein the rotatable magazine comprises:

a bullet insertion wheel having a rotation hole formed at a center thereof and a plurality of bullet insertion chambers circumferentially formed around the rotation hole;

a rear cover surrounding a rear side of the bullet insertion wheel, the rear cover comprising a rotary shaft penetrating the rotation hole and a first bullet penetrating hole formed at a portion of the rear cover below the rotary shaft;

a front cover fastened to the rear cover and rotatably surrounding a front side of the bullet insertion wheel, the front cover comprising a second bullet penetrating hole corresponding to the first bullet penetrating hole;

a wheel rotator rotating the bullet insertion wheel in a first rotational direction when there is no external force applied to the bullet insertion wheel; and a wheel rotation controller allowing sequential rotation of the bullet insertion wheel by a distance corresponding to a pitch between the bullet insertion chambers in association with movement of the bullet loading mechanism, which loads bullets received in the bullet insertion chambers into the cartridge chamber while passing through the bullet insertion chambers.

11. The magazine rifle of claim 10, wherein the rear cover is provided at a lower side thereof with a wheel spacing member protruding towards the front cover to provide a space into which the bullet insertion wheel is inserted so as to rotate therein.

12. The magazine rifle of claim 10, wherein the wheel rotator comprises:

a rotation guide groove formed on an inner surface of the rear cover;

a guide jaw protruding from a rear side of the bullet rotating wheel towards the rear cover and guiding a rotational direction of the bullet rotating wheel along the rotation guide groove; and a first elastic member disposed between the rear cover and the bullet rotating wheel to provide force for rotating the bullet rotating wheel in the first rotational direction by accumulating elasticity upon rotation of the bullet rotating wheel in a second rotational direction.

13. The magazine rifle of claim 12, wherein the rotation guide groove has a broken O-shape.

14. The magazine rifle of claim 10, wherein the wheel rotation controller comprises:

wheel rotation control grooves formed on the front side of the bullet rotating wheel inside the bullet insertion chambers;

an elevation member provided to the front cover to slide in a vertical direction, the elevation member being lifted upon forward movement of the bullet loading mechanism into the front cover and being lowered upon backward movement of the bullet loading mechanism from the front cover;

an eccentric descent mechanism compressing one side of an upper surface of the elevation member to force the elevation member to be eccentrically descended; and a rotation restricting jaw protruding from a rear side of the elevation member to restrict a rotating distance of the bullet rotating wheel so as to be equal to the pitch between the bullet insertion chambers while moving over the wheel rotation control grooves.

15. The magazine rifle of claim 14, wherein the wheel rotation control grooves comprise a plurality of chamber catching grooves corresponding to the plurality of bullet insertion chambers, respectively, each of the chamber catching grooves having an inclined surface along which the rotation restricting jaw can be easily moved to an adjacent subsequent chamber catching groove upon rotation of the bullet rotating wheel in a second rotational direction.

16. The magazine rifle of claim 14, wherein the elevation member comprises:

a body having a flat upper surface and a circular lower surface;

a movement guide hole formed through a center of the body to allow a movement guide protrusion formed on the front cover to pass therethrough; and a projection jaw protruding downwards from a lower side of the body and having a lower end descending into the second bullet penetrating hole upon downward movement of the elevation member such that the lower end of the projection jaw is moved up or down according to forward or backward movement of the bullet loading mechanism.

17. The magazine rifle of claim 14, wherein the eccentric lowering mechanism comprises:

an eccentric compression member provided to the front cover to slide in a vertical direction and to rotate thereon and eccentrically compressing one side of an upper surface of the elevation member; and a second elastic member disposed between an upper portion of the eccentric compression member and the front cover to push the elevation member to a lower side of the eccentric compression member using elasticity.

18. The magazine rifle of claim 10, wherein the rotatable magazine further comprises a surface cover coupled to a front side of the front cover and covering the wheel rotation controller.

* * * * *